US012429279B2

(12) United States Patent
Horii et al.

(10) Patent No.: US 12,429,279 B2
(45) Date of Patent: Sep. 30, 2025

(54) REFRIGERATOR DOOR OPEN/CLOSED RECOGNITION DEVICE

(71) Applicant: Panasonic Intellectual Property Management Co., Ltd., Osaka (JP)

(72) Inventors: Shinichi Horii, Shiga (JP); Kenichi Kakita, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 172 days.

(21) Appl. No.: 18/042,564

(22) PCT Filed: Aug. 3, 2021

(86) PCT No.: PCT/JP2021/028776
§ 371 (c)(1),
(2) Date: Feb. 22, 2023

(87) PCT Pub. No.: WO2022/049970
PCT Pub. Date: Mar. 10, 2022

(65) Prior Publication Data

US 2023/0332832 A1 Oct. 19, 2023

(30) Foreign Application Priority Data

Sep. 3, 2020 (JP) ..... 2020-148091

(51) Int. Cl.
*F25D 29/00* (2006.01)

(52) U.S. Cl.
CPC ..... *F25D 29/008* (2013.01); *F25D 29/005* (2013.01); *F25D 2700/02* (2013.01)

(58) Field of Classification Search
CPC ... F25D 29/005; F25D 29/008; F25D 2700/02
See application file for complete search history.

(56) References Cited

U.S. PATENT DOCUMENTS 5,479,152 A * 12/1995 Walker ..... F25D 29/008 200/61.81
5,856,781 A * 1/1999 Michel ..... F25D 29/008 62/131

(Continued)

FOREIGN PATENT DOCUMENTS

CN 201425405 Y 3/2010
GB 2507929 A 5/2014

(Continued)

OTHER PUBLICATIONS

International Search Report, International Patent Application No. PCT/JP2021/028776, Oct. 12, 2021, with English translation (4 pages).

(Continued)

*Primary Examiner* — Jonathan Bradford
(74) *Attorney, Agent, or Firm* — HSML P.C.

(57) ABSTRACT

A door open/closed recognition device is configured to be attached to a top surface of an exterior of a refrigerator to be used. The door open/closed recognition device includes an attachment portion that is provided on a bottom surface of the door open/closed recognition device and configured to fix the door open/closed recognition device on the top surface; a wireless communication unit that performs a wireless communication with a communication terminal; and a door open/closed recognition unit. The door open/closed recognition unit includes a sensor configured to detect an object which exists within a detection area at a front surface of the refrigerator in a state where the door open/closed recognition device is attached on the top surface; and a processor configured to recognize an open or closed state of a door of the refrigerator based on a detection result of the sensor.

8 Claims, 5 Drawing Sheets

(56) References Cited

U.S. PATENT DOCUMENTS

| | | | | |
|---|---|---|---|---|
| 8,436,628 | B2 * | 5/2013 | Uhov | G01D 5/241 324/660 |
| 2015/0149619 | A1 | 5/2015 | Tsuji et al. | |
| 2016/0057394 | A1 | 2/2016 | Marutani et al. | |
| 2016/0182864 | A1 * | 6/2016 | Izawa | H04N 5/44 348/143 |
| 2016/0223250 | A1 | 8/2016 | Kang et al. | |
| 2019/0335145 | A1 | 10/2019 | Izawa et al. | |

FOREIGN PATENT DOCUMENTS

| | | | |
|---|---|---|---|
| JP | 2014-026640 | A | 2/2014 |
| JP | 2015-65630 | A | 4/2015 |
| WO | 2014/142120 | A1 | 9/2014 |
| WO | 2019/058590 | A1 | 3/2019 |

OTHER PUBLICATIONS

Extended European Search Report issued in European Patent Application No. 21864028.2, Jan. 26, 2024 (7 pages).

* cited by examiner

REFRIGERATOR DOOR OPEN/CLOSED RECOGNITION DEVICE

TECHNICAL FIELD

The present invention relates to a usage notification device that provides a notification about the usage of a refrigerator.

BACKGROUND

Patent Literature 1 discloses a watch-over system that monitors the living condition of a person to be watched who is a user of a refrigerator, based on changes in the amount of foodstuffs in the refrigerator. The refrigerator constituting the watch-over system includes: a sensor that detects the amount of foodstuffs in the refrigerator; and a communication unit that transmits data of the amount of foodstuffs detected by the sensor to a communication terminal of a watcher who monitors the living condition of the person to be watched.

CITATION LIST

Patent Literature

[Patent Literature 1]
WO2019/058590

SUMMARY OF INVENTION

Technical Problem

The above watch-over system uses a communication function included in the refrigerator, to transmit the data of the amount of foodstuffs to the communication terminal of the watcher. Therefore, when the person to be watched uses a refrigerator not provided with a communication function, the function of providing a notification about the usage of the refrigerator to the communication terminal of the watcher cannot be implemented.

In view of the above background, the present disclosure provides a usage notification device that allows a refrigerator not provided with a communication function to have added thereto a function of providing the usage to a communication terminal.

Solution to Problem

The present description includes the entire contents of Japanese Patent Application No. 2020-148091 filed on Sep. 3, 2020.

A usage notification device for a refrigerator in the present disclosure includes: an attachment portion for attachment to an exterior of the refrigerator; a wireless communication unit that performs a wireless communication with a communication terminal; a door open/closed recognition unit that recognizes the open or closed state of a door of the refrigerator; and a notification control unit that transmits usage information on the refrigerator based on the open or closed state of the door which is recognized by the door open/closed recognition unit, to the communication terminal by the wireless communication unit.

Advantageous Effect of Invention

Attaching the usage notification device for a refrigerator in the present disclosure to an exterior of the refrigerator allows usage information on the refrigerator based on the recognition status of a door open or closed state of the refrigerator to be transmitted to a communication terminal. As a result, a function of providing a notification about the usage can be added to a refrigerator not provided with a communication function.

DESCRIPTION OF EMBODIMENTS (Underlying Knowledge and the Like Forming the Basis of the Present Disclosure)

At the time when the inventors reached an idea of the present disclosure, a notification about the usage of a refrigerator was performed using a sensor and a communication function that were originally provided in the refrigerator. Specifically, configuration was such that the amount of foodstuffs in the refrigerator was detected by the sensor and data of the amount of foodstuffs that was detected by the sensor was transmitted to a communication terminal of a watcher or the like who monitored the living condition of a person to be watched.

However, among commercially available refrigerators, some refrigerators are not provided with a communication function. The inventors has found that for such refrigerators not provided with a communication function, the above configuration cannot be applied to transmit the usage of the refrigerator to a communication terminal. Then, to solve this problem, the inventors have conceived of the subject matter of the present invention.

Thus, the present disclosure provides a usage notification device that allows a refrigerator not provided with a communication function to have added thereto a function of providing the usage to a communication terminal.

Hereinafter, an embodiment will be described in detail with reference to drawings. Note that detailed description more than necessary may be omitted. For example, detailed descriptions on well-known matters or redundant descriptions of substantially identical components may be omitted. This is done to avoid unnecessary redundancy in the descriptions below and facilitate understanding for those skilled in the art.

Note that the accompanying drawings and the following descriptions are provided to help those skilled in the art to fully understand the present disclosure, and do not intend to limit the subject matter of the claims

Embodiment

Hereinafter, an embodiment will be described with reference to FIG. 1 to FIG. 5.

[1. Configuration]

[1-1. Use Mode of Usage Notification Device]

Figure 1:
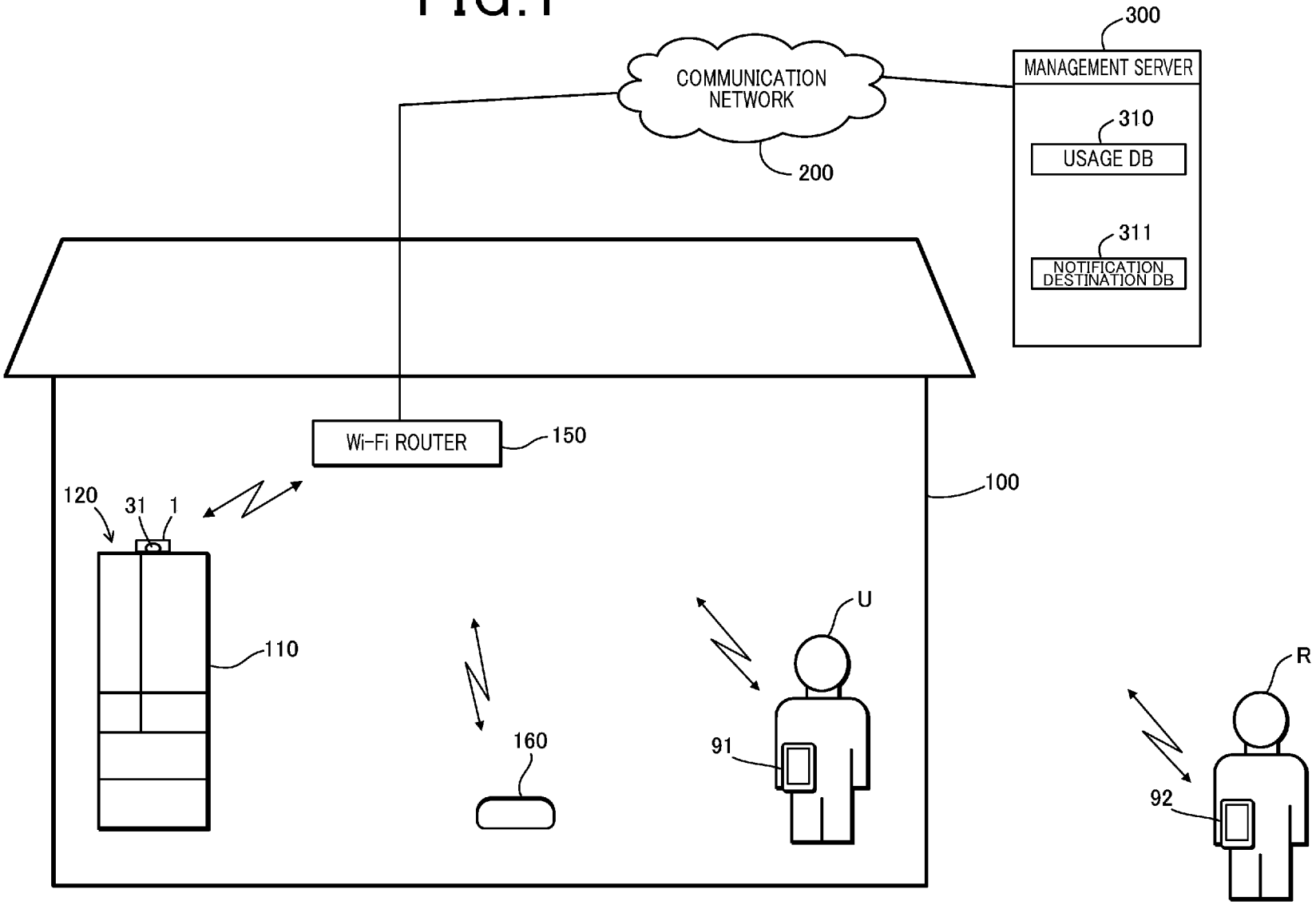
FIG. 1 is an illustration of a use mode of a usage notification device of an embodiment.

A use mode of a usage notification device 1 in the present disclosure will be described with reference to FIG. 1. The usage notification device 1 is attached onto a top surface 120 of an exterior of a refrigerator 110 that is placed in a house 100. The usage notification device 1 includes a range sensor 31 having a detection area around a front surface of the refrigerator 110 and has a Wi-Fi® wireless communication function.

The house 100 has a Wi-Fi router 150 in it. The usage notification device 1 performs a wireless communication via the Wi-Fi router 150 with a user terminal 91 used by a user U who lives in the house 100 and with a smart speaker 160 used in the house 100. Note that the wireless communication of the usage notification device 1 with the user terminal 91 and the smart speaker 160 may be performed in compliance with a communication standard such as Bluetooth® other than Wi-Fi. The user terminal 91 and the smart speaker 160 correspond to a communication terminal of the present disclosure.

In addition, the usage notification device 1 performs a wireless communication via the Wi-Fi router 150 and a communication network 200 with a management server 300 and a related-person terminal 92 used by a related person R who has a predetermined relation with the user U. A configuration in which the management server 300 performs communication and the related-person terminal 92 correspond to a communication terminal of the present disclosure.

The usage notification device 1 recognizes the open or closed state of a door of the refrigerator 110 based on detected data (range data) of a distance to an object that exists within a detection area which is obtained by the range sensor 31. In addition, the usage notification device 1 transmits usage information on the refrigerator 110 based on the open or closed state of the door of the refrigerator 110, to the user terminal 91, the smart speaker 160, the related-person terminal 92, and the management server 300.

In this embodiment, the usage notification device 1 transmits, when the door of the refrigerator 110 is kept in an open state for a predetermined forgot-to-close determination time or longer, forgot-to-close-door information for notifying that the door is forgotten to be closed, to the smart speaker 160 and the user terminal 91. Upon receipt of the forgot-to-close-door information, the smart speaker 160 outputs a voice message such as "the door of the refrigerator is open," thereby notifying that the door of the refrigerator 110 is open. Upon receipt of the forgot-to-close-door information, the user terminal 91 displays a notification screen for notifying that the door of the refrigerator 110 is open and also outputs a sound for notifying that the door of the refrigerator 110 is open.

In addition, the usage notification device 1 transmits user abnormality information for providing a notification about an abnormality of the user U to the related-person terminal 92 and the management server 300 when the door of the refrigerator 110 is neither opened nor closed for a predetermined unuse determination time or longer. The related-person terminal 92 displays a screen that prompts to, for example, confirm the safety of the user U when receiving the user abnormality information.

The management server 300 includes a usage database (DB) 310 and a notification destination DB 311. The management server 300 receives the user abnormality information transmitted from the usage notification device 1 via the communication network 200 and records the received user abnormality information in the usage DB 310. In the notification destination DB 311, a communication address of a communication terminal of an emergency organization or the like that is registered in advance as a destination to which an abnormality of the user U is notified is recorded. Upon receipt of the user abnormality information, the management server 300 transmits relief-and-protection request information including information of the user U, an address of the house 100, and the like to the communication terminal of the emergency organization or the like so as to request the relief and protection of the user U.

[1-2. Configuration of Usage Notification Device]

Figure 2:
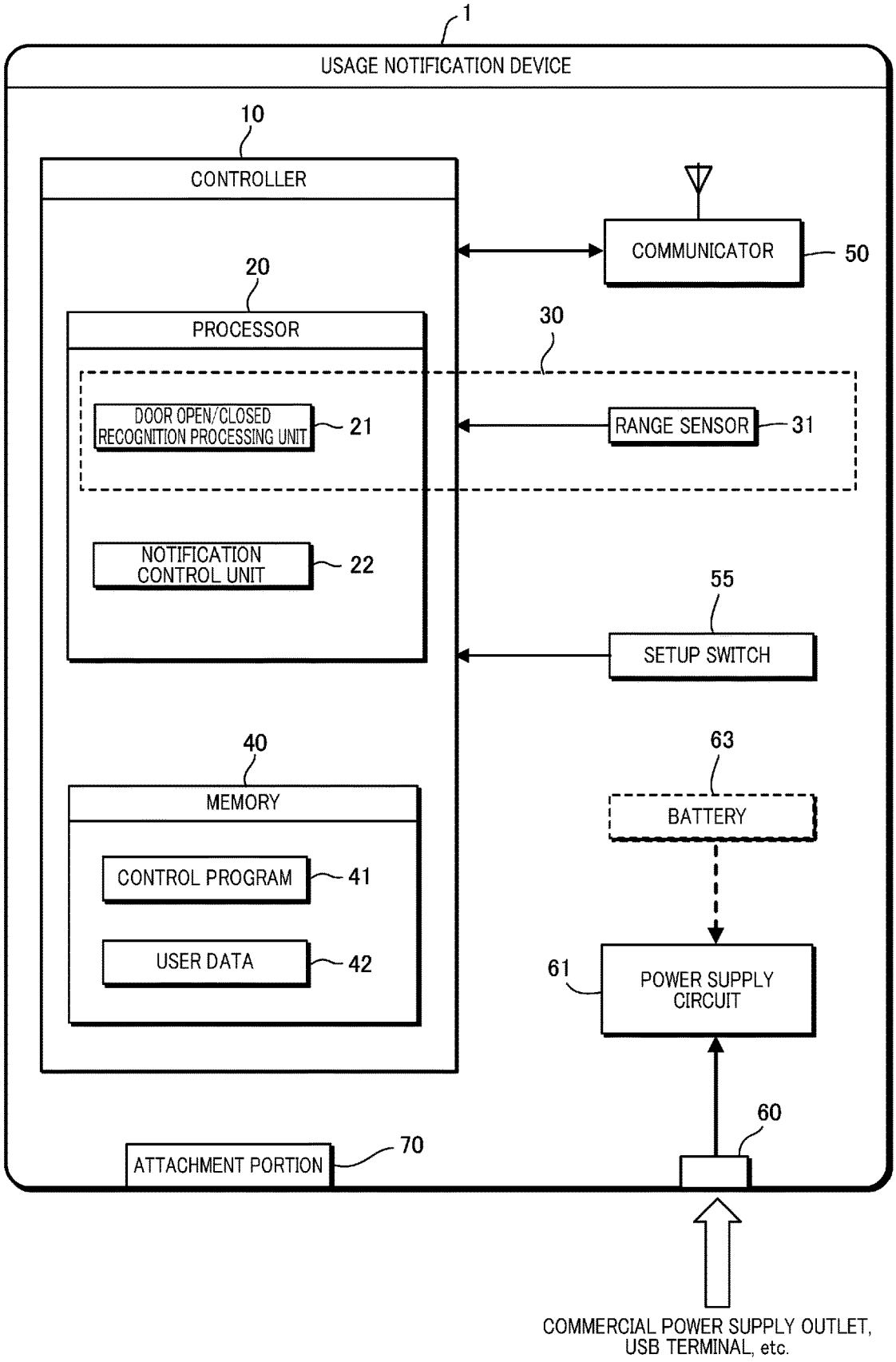
FIG. 2 is a block diagram of the usage notification device of the embodiment.

Next, a configuration of the usage notification device 1 will be described with reference to FIG. 2 and FIG. 3. The usage notification device 1 includes a controller 10, a range sensor 31, a communicator 50, a setup switch 55, an external power supply port 60, a power supply circuit 61, and an attachment portion 70. The communicator 50 corresponds to a wireless communication unit of the present disclosure.

Figure 3:
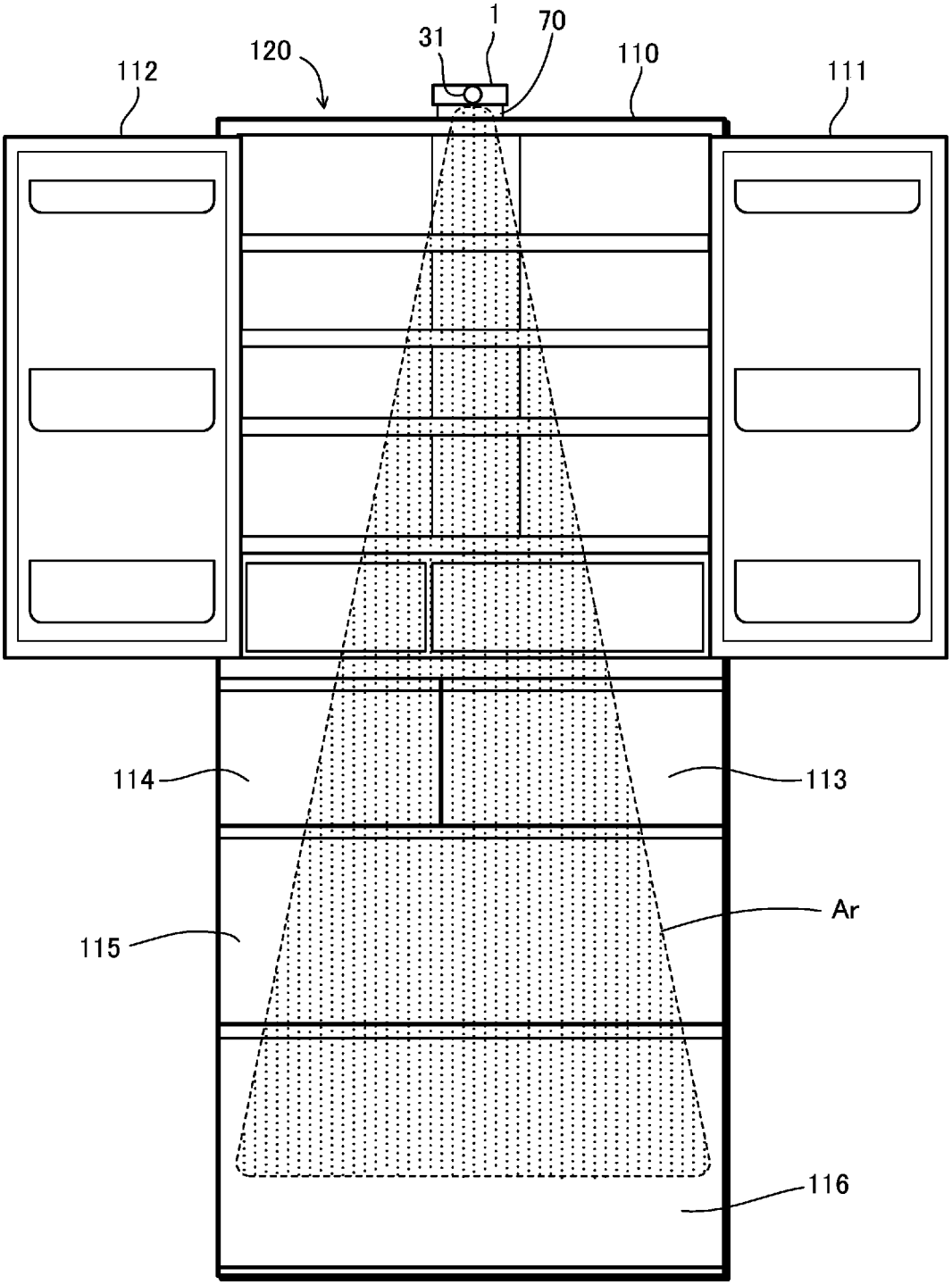
FIG. 3 is an illustration of both an attachment mode of the usage notification device of the embodiment and a detection range of a range sensor.

The attachment portion 70 is arranged on a bottom surface of the usage notification device 1 as illustrated in FIG. 3 and fixes the usage notification device 1 on the top surface 120 of the exterior of the refrigerator 110. The attachment portion 70 fixes the usage notification device 1 on the top surface 120 of the refrigerator 110 by, for example, magnet, a suction cup, double-sided tape, or the like. The range sensor 31 detects a distance from around the top surface 120 to an object that exists within a detection area Ar around a front surface of the refrigerator 110 in a state where the usage notification device 1 is attached on the top surface 120 of the refrigerator 110 as illustrated in FIG. 3.

The refrigerator 110 includes: a right refrigeration compartment door 111 and a left refrigeration compartment door 112 that are of hinged type; and a first freezer compartment door 113, an ice maker compartment door 114, a second freezer compartment door 115, and a vegetable compartment door 116 that are of drawer type. A distance detected by the range sensor 31 differs between the closed state and open state of any door. Therefore, detecting a displacement of any door of the refrigerator 110 based on a range signal from the range sensor 31 allows recognition that any door of the refrigerator 110 is in an open state or all the doors of the refrigerator 110 are in a closed state.

The communicator 50 performs a wireless communication by Wi-Fi, Bluetooth, or the like as described above. The external power supply port 60 is connected to a commercial power supply outlet installed in the house 100 or to a universal serial bus (USB®) terminal equipped on the refrigerator 110; and supplies power to the power supply circuit 61. The power supply circuit 61 performs rectification, transformation, and the like of the power that is supplied from the external power supply port; and supplies operating power to the controller 10, the communicator 50, and the range sensor 31. It is noted that the configuration may be such that power is supplied from a battery 63 to the power supply circuit 61. The setup switch 55 is provided to perform an operation such as registering the usage notification device 1 in the Wi-Fi router 150.

The controller 10 includes a processor 20, a memory 40, and an interface circuit that is not illustrated. The processor 20 is composed of one or a plurality of core processors. In the memory 40, a control program 41 of the usage notification device 1 and user data 42 are stored. In the user data 42, communication addresses of the user terminal 91, the smart speaker 160, the related-person terminal 92, and the management server 300 are recorded. Setting of those communication addresses are made by an app (application program) for using the usage notification device 1, the app being executed by the user terminal 91 or the related-person terminal 92.

The processor 20 reads and executes the control program 41 stored in the memory 40, thereby functioning as a door open/closed recognition processing unit 21 and a notification control unit 22. The door open/closed recognition processing unit 21 executes processing of recognizing the open or closed states of the doors 111 to 116 of the refrigerator 110, based on the range data that is output from the range sensor 31. The door open/closed recognition processing unit 21 and the range sensor 31 constitute a door open/closed recognition unit 30 that recognizes the open or closed states of the doors 111 to 116.

The notification control unit 22 executes both forgot-to-close-door notification processing for transmitting the forgot-to-close-door information described above and user abnormality notification processing for transmitting the user abnormality information described above, based on a result of recognizing the open or closed states of the doors 111 to 116 by the door open/closed recognition unit 30. Details of the forgot-to-close-door notification processing and the user abnormality notification processing will be described later.

[2. Operation]

The operation of the usage notification device 1 that is executed by the door open/closed recognition unit 30 and the notification control unit 22 will be described based on the flowcharts illustrated in FIG. 4 and FIG. 5.

[2-1. Forgot-to-Close-Door Notification Processing]

The forgot-to-close-door notification processing will be described based on the flowchart illustrated in FIG. 4. The door open/closed recognition unit 30 and the notification control unit 22 repeatedly execute the forgot-to-close-door notification processing according to the flowchart illustrated in FIG. 4 when the usage notification device 1 is operating.

Figure 4:
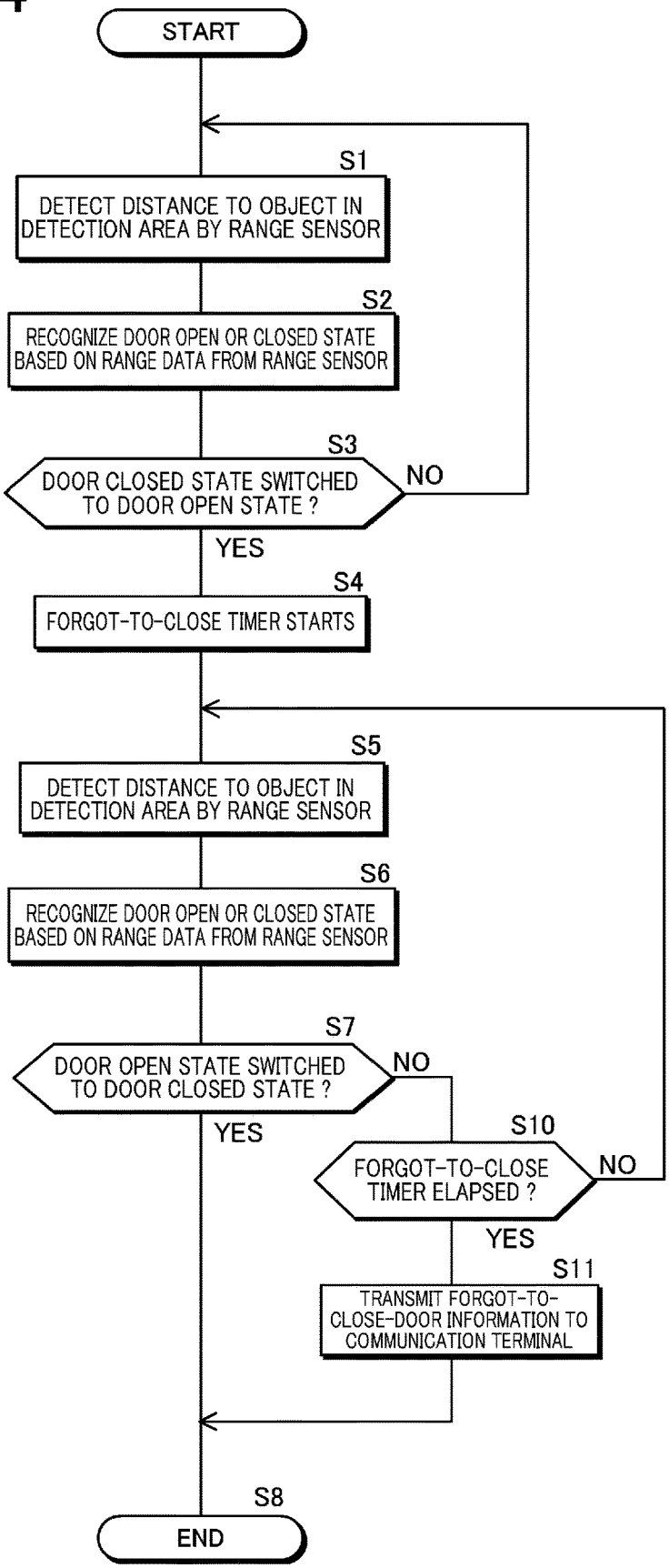
FIG. 4 is a flowchart of forgot-to-close notification processing of the embodiment.

At step S1 in FIG. 4, the door open/closed recognition unit 30 detects a distance to an object in the detection area Ar by the range sensor 31. At a subsequent step S2, the door open/closed recognition unit 30 recognizes the open or closed states of the doors 111 to 116 of the refrigerator 110, based on range data from the range sensor 31. Hereinafter, a state where all of the doors 111 to 116 of the refrigerator 110 are in a closed state is referred to as a door closed state of the refrigerator 110 and a state where at least one of the doors 111 to 116 is in an open state is referred to as a door open state of the refrigerator 110.

At a next step S3, the notification control unit 22 determines whether it is recognized by the door open/closed recognition unit 30 that the door closed state of the refrigerator 110 has been switched to the door open state. Then, if it is recognized that the door closed state of the refrigerator 110 has been switched to the door open state, the notification control unit 22 advances processing to step S4. If it is not recognized that the door closed state of the refrigerator 110 has been switched to the door open state, the notification control unit 22 advances processing to step S1.

At step S4, the notification control unit 22 starts a forgot-to-close timer when the door closed state of the refrigerator 110 is switched to the door open state. A set time on the forgot-to-close timer (forgot-to-close determination time) is three minutes, for example. At a subsequent step S5, the door open/closed recognition unit 30 recognizes the open or closed states of the doors 111 to 116 of the refrigerator 110, based on range data from the range sensor 31.

At a next step S7, the notification control unit 22 determines whether it is recognized by the door open/closed recognition unit 30 that the door open state of the refrigerator 110 has been switched to the door closed state. Then, if it is recognized that the door open state of the refrigerator 110 has been switched to the door closed state, the notification control unit 22 advances processing to step S8 and ends processing according to the flowchart in FIG. 4. If it is not recognized that the door open state of the refrigerator 110 has been switched to the door closed state, the notification control unit 22 advances processing to step S10.

At step S10, the notification control unit 22 determines whether the forgot-to-close timer has elapsed (whether the forgot-to-close determination time has elapsed). If the forgot-to-close timer has elapsed, the notification control unit 22 advances processing to step S11 and if the forgot-to-close timer has not elapsed, it advances processing to step S5. At step S11, the notification control unit 22 transmits forgot-to-close-door information for notifying that the door of the refrigerator 110 is open, to the user terminal 91 and the smart speaker 160 via the communicator 50; and advances processing to step S8 in FIG. 4. Thus, as described above, the processing of notifying that the door of the refrigerator 110 is forgotten to be closed is executed on the user terminal 91 and the smart speaker 160 that have received the forgot-to-close-door information.

[2-2. User Abnormality Notification Processing]

The user abnormality notification processing will be described based on the flowchart illustrated in FIG. 5. The notification control unit 22 and the door open/closed recognition unit 30 execute the user abnormality notification processing according to the flowchart in FIG. 5 each time it is recognized by the door open/closed recognition unit 30 that the door open state of the refrigerator 110 has been switched to the door closed state.

Figure 5:
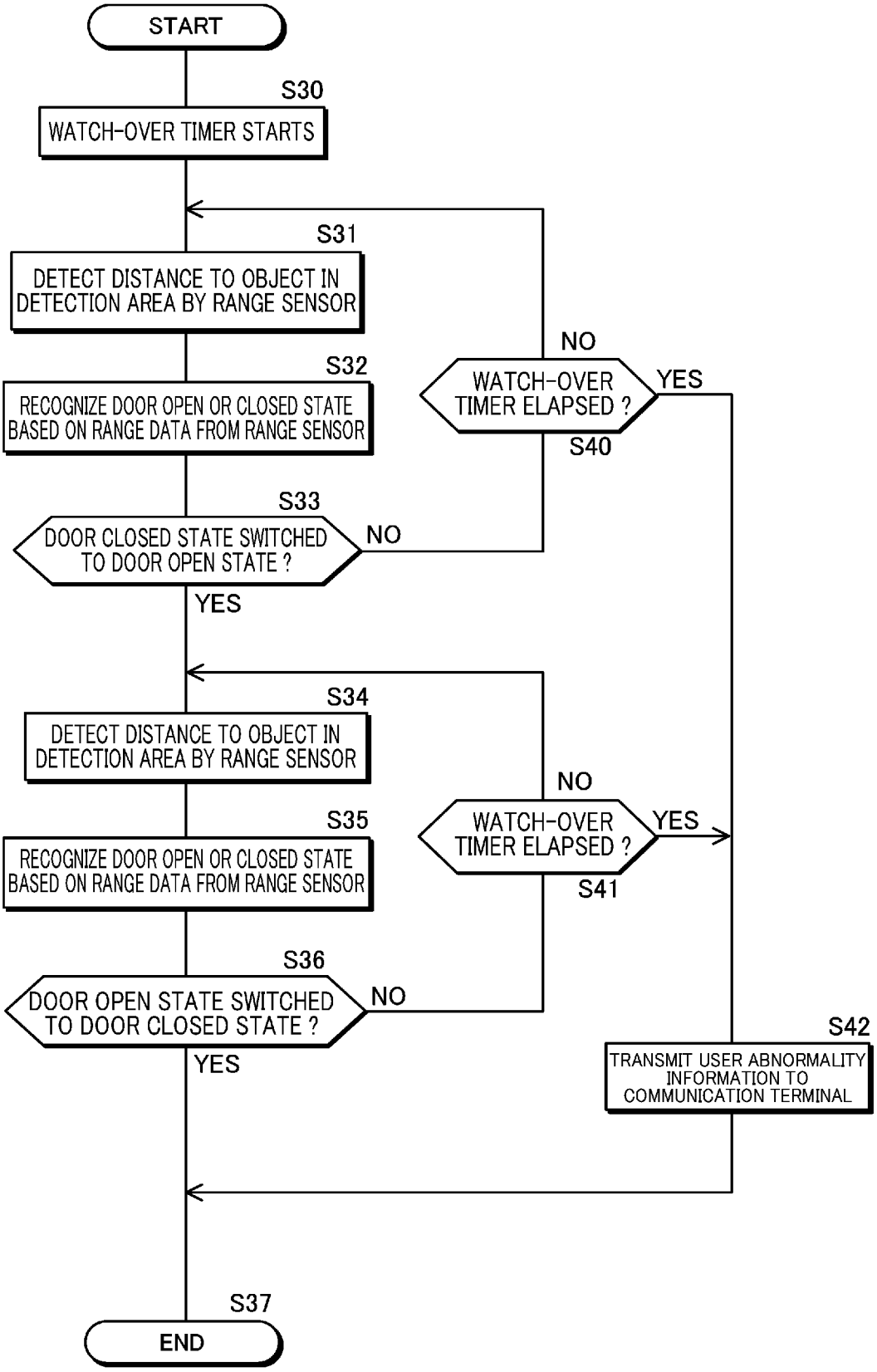
FIG. 5 is a flowchart of watch-over notification processing of the embodiment.

At step S30 in FIG. 5, the notification control unit 22 starts a watch-over timer. Set time of the watch-over timer is 24 hours, for example. At a subsequent step S31, the door open/closed recognition unit 30 detects a distance to an object in the detection area Ar by the range sensor 31. At a next step S32, the door open/closed recognition unit 30 recognizes the open or closed states of the doors of the refrigerator 110, based on range data from the range sensor 31.

At a subsequent step S33, the notification control unit 22 determines whether it is recognized by the door open/closed recognition unit 30 that the door closed state of the refrigerator 110 has been switched to the door open state. Then, when it is recognized that the door closed state of the refrigerator 110 has been switched to the door open state, the notification control unit 22 advances processing to step S34. If it is not recognized that the door closed state of the refrigerator 110 has been switched to the door open state, the notification control unit 22 advances processing to step S40.

At step S40, the notification control unit 22 determines whether the watch-over timer has elapsed. If the watch-over timer has elapsed, the notification control unit 22 advances processing to step S42 and if the watch-over timer has not elapsed, it advances processing to step S31.

At step S42, the notification control unit 22 transmits user abnormality information for notifying that there is a possibility of the occurrence of an abnormality on the user U, to the related-person terminal 92 and the management server 300 by the communicator 50; and advances processing to step S37. This causes processing of providing a notification about the abnormality of the user U and prompting to confirm the safety of the user U to be executed on the related-person terminal 92 and the management server 300, as described above.

At step S34, the door open/closed recognition unit 30 detects a distance to the object in the detection area Ar by the range sensor 31. At a next step S35, the door open/closed recognition unit 30 recognizes the open or closed states of the doors of the refrigerator 110, based on range data from the range sensor 31. At a subsequent step S36, the notification control unit 22 determines whether it is recognized by the door open/closed recognition unit 30 that the door open state of the refrigerator 110 has been switched to the door closed state.

Then, if it is recognized that the door open state of the refrigerator 110 has been switched to the door closed state, the notification control unit 22 advances processing to step S37 and ends user abnormality notification processing according to the flowchart in FIG. 5. If it is not recognized that the door open state of the refrigerator 110 has been switched to the door closed state, the notification control unit 22 advances processing to step S41.

At step S41, the notification control unit 22 determines whether the watch-over timer has elapsed. Then, if the watch-over timer has elapsed, the notification control unit 22 advances processing to step S42, and this causes processing of providing a notification about the abnormality of the user U and prompting to confirm the safety of the user U to be executed on the related-person terminal 92 and the management server 300, as described above. If the watch-over timer has not elapsed, the notification control unit 22 advances processing to step S34.

[3. Effect and Others]

As described above, in the present embodiment, the usage notification device 1 includes the attachment portion 70, the controller 10, the range sensor 31, and the communicator 50; and the usage notification device 1 is attached to a top surface of the refrigerator 110 by the attachment portion 70. The processor 20 included in the controller 10 functions as the door open/closed recognition processing unit 21 and the notification control unit 22; and the door open/closed recognition processing unit 21 and the range sensor 31 constitute the door open/closed recognition unit 30.

Thereby, the door open/closed recognition unit 30 recognizes the open or closed states of the doors 111 to 116 of the refrigerator 110, based on the range data in the detection area Ar around the front surface of the refrigerator 110 which is obtained by the range sensor 31. Then, the notification control unit 22 notifies, by the communicator 50, communication terminals such as the user terminal 91, the related-person terminal 92, the smart speaker 160, and the management server 300 of the forgot-to-close-door information and watch-over information, based on a result of recognition of the open or closed state of the doors 111 to 116 of the refrigerator 110. Thus, even a refrigerator 110 not provided with a communication function can have added thereto a function of providing a notification about the usage to the communication terminal by having the usage notification device 1 attached thereon.

Other Embodiments

As described above, the above embodiment has been described as an illustration of a technique disclosed in the present application. However, the technique of the present disclosure is not limited thereto and may also be applied to embodiments in which modification, replacement, addition, omission, or the like has been made. Then, other embodiments will be illustrated below.

In the above embodiment, the door open/closed recognition unit 30 recognizes the open or closed states of the doors 111 to 116 of the refrigerator 110, using the range sensor 31. However, other types of sensors and the like may be used. For example, a camera may be provided, in which an image of an area around the front surface of the refrigerator 110 is captured by the camera, an image part of the doors 111 to 116 included in the captured image is extracted, and thereby the open or closed states of the doors 111 to 116 are recognized. Alternatively, a brightness sensor may be provided, in which the brightness of a detection area around the front surface of the refrigerator 110 is detected and thereby, the open or closed states of the doors 111 to 116 are recognized.

In the above embodiment, the notification control unit 22 transmits, to the communication terminal, forgot-to-close-door information and user abnormality information as usage information on the refrigerator 110 based on the open or closed states of the doors of the refrigerator 110 which are recognized by the door open/closed recognition unit 30. In another embodiment, the configuration may be such that only either the forgot-to-close-door information or the user abnormality information is transmitted to the communication terminal. In addition, usage information other than the forgot-to-close-door information and user abnormality information may be transmitted to the communication terminal. For example, when it is recognized that a door of the refrigerator 110 is opened or closed, usage information for notifying that the refrigerator 110 has been used is transmitted to the communication terminal.

It is only required that the controller in the present disclosure can control the usage notification device of the present disclosure. In expressing the subject matter of the invention, one that controls the device of the present disclosure may be indicated by control means, a control unit, or a wording similar thereto, in addition to the controller. The controller may be implemented in various modes. For example, a processor may be used as the controller. Using a processor as the controller enables various processes to be executed by making the processor read a program from a storage medium having the program stored therein and execute the program. Therefore, changing the program stored in the storage medium can make a change in a processing content, which can increase the flexibility in changing the control content. The processor is, for example, a central processing unit (CPU) or a micro-processing unit (MPU). The recording medium is, for example, a hard disk, a flash memory, or an optical disk. Alternatively, a wired logic in which a program cannot be rewritten may be used as the controller. Using a wired logic as the controller is effective in increasing a processing speed. The wired logic is, for example, an application specific integrated circuit (ASIC). Alternatively, the controller may be implemented in combination of a processor and a wired logic. With the controller implemented in combination of a processor and a wired logic, a processing speed can be increased while increasing the flexibility in software design. Alternatively, the controller and a circuit having a function different from that of the controller may be constituted in one semiconductor element. The circuit having a different function is, for example, an A/D, D/A conversion circuit. Alternatively, the controller may be constituted in one semiconductor element or may be formed from a plurality of semiconductor elements. In a case where it is formed from a plurality of semiconductor elements, each control in the claims may be implemented by a mutually different semiconductor element. Still alternatively, the controller may be configured so as to include a semiconductor element and a passive component such as a resistor or capacitor It is only required that the communicator in the present disclosure allows communication between the usage notification device of the present disclosure and an external apparatus. In expressing the subject matter of the invention, one that allows communication between the device of the present disclosure and an external apparatus may be indicated by communication means, a communication unit, transmission/reception means, a transmission/reception unit, or a wording similar thereto, in addition to the communicator. The communicator may be implemented in various modes. As the communicator, a wireless connection with an external apparatus via a base station or the like, a direct wireless connection with the external apparatus, or the like is used. For the wireless connection with an external apparatus via a base station or the like, a wireless LAN compliant with IEEE802.11 which performs a wireless communication with a Wi-Fi® router, a third generation mobile communication system (commonly known as 3G), a fourth generation mobile communication system (commonly known as 4G), WiMax® compliant with IEEE 802.16, or low power wide area LPWA) is used, for example. Using a communicator that directly connects the device of the present disclosure and an external apparatus is effective in increasing the security of communication and also, allows the device of the present disclosure to communicate with the external apparatus even at a place where a relay device such as a Wi-Fi® router does not exist. As the communicator that directly connects the device of the present disclosure and an external apparatus, Bluetooth® communication, near field communication (NFC) via a loop antenna, or an infrared communication is used, for example.

The above embodiments are for illustrating the technique of the present disclosure; and various modifications, replacements, additions, omissions, or the like may be performed within the scope of the claims or the equivalents thereof.

INDUSTRIAL APPLICABILITY

The present disclosure is applicable for use in adding, to a refrigerator not provided with a communication function by attachment thereon, the function of transmitting usage information based on the door open or closed state of the refrigerator to a communication terminal.

REFERENCE SIGNS LIST

1 usage notification device
10 controller
20 processor
21 door open/closed recognition processing unit
22 notification control unit
30 door open/closed recognition unit
31 range sensor
40 memory
41 control program
50 communicator
55 setup switch
60 power supply port
61 power supply circuit
63 battery
70 attachment portion
91 user terminal
92 related-person terminal
100 house
110 refrigerator
111 right refrigeration compartment door
112 left refrigeration compartment door
113 first freezer compartment door
114 ice maker compartment door
115 second freezer compartment door
116 vegetable compartment door
150 Wi-Fi router
160 smart speaker
200 communication network
300 management server
310 usage DB
311 notification destination DB

The invention claimed is:

1. A door open/closed recognition device configured to be attached to a top surface of an exterior of a refrigerator to be used, comprising:

an attachment portion that comprises a magnet, a suction cup, or a double-sided tape provided on a bottom surface of the door open/closed recognition device and configured to fix the door open/closed recognition device on the top surface;

a wireless communication unit that performs a wireless communication with a communication terminal; and a door open/closed recognition unit, wherein the door open/closed recognition unit includes:

a sensor that has a detection area at a front surface of the refrigerator in a state where the door open/closed recognition device is attached on the top surface and that is configured to detect, from the top surface, an object which exists within the detection area at the front surface of the refrigerator; and a processor configured to recognize an open or closed state of a door of the refrigerator based on a detection result of the sensor, the door open/closed recognition unit is configured to recognize that any door of the refrigerator is in the open state or all doors of the refrigerator are in the closed state, based on a difference of a detected data that is output from the sensor.

2. The door open/closed recognition device according to claim 1, wherein when it is not recognized by the door open/closed recognition unit that the open state of the door has been switched to the closed state of the door before a predetermined forgot-to-close determination time has elapsed after it is recognized by the door open/close recognition unit that the closed state of the door has been switched to the open state of the door, a notification control unit transmits forgot-to-close-door information to the communication terminal by the wireless communication unit, the communication terminal being configured to be used by a user of the refrigerator, the forgot-to-close-door information being for notifying that the door is forgotten to be closed.

3. The door open/closed recognition device according to claim 1, wherein when a status in which it is not recognized by the door open/closed recognition unit that the closed state of the door has been switched to the open state of the door or the open state of the door has been switched to the closed state of the door continues for a predetermined unuse determination time or longer, a notification control unit transmits user abnormality information to the communication terminal by the wireless communication unit, the user abnormality information being configured for providing a notification about an abnormality of the user of the refrigerator, the communication terminal being used by a related person who has a predetermined relation with the user.

4. The door open/closed recognition device according to claim 1, wherein the sensor is a range sensor; and the door open/closed recognition unit is configured to recognize the open or closed state of the door of the refrigerator based on a range data that is output from the range sensor.

5. The door open/closed recognition device according to claim 1, wherein the sensor is a camera, and the door open/closed recognition unit is configured to recognize the open or closed state of the door of the refrigerator by extracting an image part of the door included in an image that is captured by the camera.

6. The door open/closed recognition device according to claim 1, wherein the sensor is a brightness sensor, and the door open/closed recognition unit is configured to recognize the open or closed state of the door of the refrigerator based on brightness data that is output from the brightness sensor.

7. The door open/closed recognition device according to claim 1, wherein the attachment portion comprises the magnet.

8. The door open/closed recognition device according to claim 1, wherein the processor functions as a notification control unit that transmits information to the communication terminal via the wireless communication unit, the information being based on the open or closed state of the door that is recognized by the door open/closed recognition unit.

* * * * *